US008567362B2

(12) United States Patent
Hiramatsu et al.

(10) Patent No.: US 8,567,362 B2
(45) **Date of Patent: *Oct. 29, 2013**

(54) VEHICLE ENGINE

(75) Inventors: Naoki Hiramatsu, Nishio (JP); Masahide Sakurai, Nishio (JP)

(73) Assignee: Otics Corporation, Aichi (JP)

( * ) Notice: Subject to any disclaimer, the term of this patent is extended or adjusted under 35 U.S.C. 154(b) by 310 days.

This patent is subject to a terminal disclaimer.

(21) Appl. No.: 12/897,024

(22) Filed: Oct. 4, 2010

(65) Prior Publication Data

US 2011/0079192 A1 Apr. 7, 2011

(30) Foreign Application Priority Data

Oct. 5, 2009 (JP) ..... 2009-231654

(51) Int. Cl.
*F01L 1/32* (2006.01)
*F01M 1/06* (2006.01)
*F01M 9/10* (2006.01)

(52) U.S. Cl.
USPC ..... 123/90.33; 123/90.34; 123/90.38

(58) Field of Classification Search
USPC ..... 123/90.33
See application file for complete search history.

(56) References Cited

U.S. PATENT DOCUMENTS

| | | | | |
|---|---|---|---|---|
| 5,143,034 | A * | 9/1992 | Hirose | 123/196 R |
| RE35,382 | E * | 11/1996 | Saito | 123/90.27 |
| 5,875,754 | A | 3/1999 | Ickinger | |
| 6,470,840 | B1 * | 10/2002 | Ebesu et al. | 123/90.17 |
| 6,880,506 | B2 * | 4/2005 | Gschwindt et al. | 123/90.38 |
| 7,891,328 | B2 * | 2/2011 | Nishida et al. | 123/90.33 |
| 8,132,550 | B2 * | 3/2012 | Oishi et al. | 123/90.33 |
| 8,166,939 | B2 * | 5/2012 | Lopez-Crevillen et al. | 123/90.34 |
| 8,307,800 | B2 * | 11/2012 | Staley et al. | 123/90.34 |
| 2004/0011314 | A1 * | 1/2004 | Seader et al. | 123/90.34 |
| 2006/0112922 | A1 * | 6/2006 | Yoshijima et al. | 123/90.33 |
| 2007/0113812 | A1 * | 5/2007 | Yoshijima et al. | 123/90.38 |
| 2007/0289565 | A1 * | 12/2007 | Fujii et al. | 123/90.33 |
| 2009/0107435 | A1 * | 4/2009 | Nishida et al. | 123/90.33 |
| 2010/0012063 | A1 * | 1/2010 | Shoji | 123/90.33 |
| 2010/0294220 | A1 * | 11/2010 | Ferreri et al. | 123/90.11 |
| 2010/0313838 | A1 * | 12/2010 | Yoon et al. | 123/90.33 |
| 2011/0083627 | A1 * | 4/2011 | Hiramatsu et al. | 123/90.34 |

FOREIGN PATENT DOCUMENTS

| | | |
|---|---|---|
| DE | 196 19 183 | 7/1997 |
| DE | 103 04 304 | 8/2004 |
| JP | 63-24319 | 2/1988 |
| JP | 05-209507 | 8/1993 |
| JP | 10-047156 | 2/1998 |
| JP | 2008-106701 | 5/2008 |
| WO | WO 2006041255 A1 * | 4/2006 |

* cited by examiner

*Primary Examiner* — Zelalem Eshete
*Assistant Examiner* — Steven D Shipe
(74) *Attorney, Agent, or Firm* — Wenderoth, Lind & Ponack, L.L.P.

(57) ABSTRACT

A vehicle engine includes a cylinder head, a cam housing fixed to a top of the cylinder head, a cam cap fixed to a top of the cam housing, a camshaft rotatably supported between the cam housing and the cam cap, the camshaft supporting a cam, a rocker arm configured to be pushed by the cam, and a valve configured to operate by being pushed by the rocker arm. The vehicle engine has an oil pipe that is formed integrally with the cam housing.

5 Claims, 7 Drawing Sheets

VEHICLE ENGINE

CROSS REFERENCE TO RELATED APPLICATION

This application claims priority from Japanese Patent Application No. 2009-231654 filed on Oct. 5, 2009. The entire content of this priority application is incorporated herein by reference.

TECHNICAL FIELD

The present invention relates to a vehicle engine.

BACKGROUND

A typical vehicle engine includes a cylinder head, a cam housing, a cam cap, camshafts, rocker arms, and valves. The cam housing is fixed to a top of the cylinder head. The cam cap is fixed to a top of the cam housing. The camshafts are rotatably supported between the cam housing and the cam cap. Each camshaft includes cams. The cams push the rocker arms, while the rocker arms push the valves so that the valves operate. One of such typical vehicle engines further includes a shower pipe wherethrough lubricant oil is supplied to contact points between the cams and the rocker arms.

The shower pipe is generally a separate part attached to the cam cap or to a head cover that covers the cam cap. That is, a part separate from the cam cap or from the head cover is necessary as the shower pipe. The parts count of the vehicle engine is higher accordingly.

Thus, there is a need for a vehicle engine with a lower parts count.

SUMMARY

An aspect in accordance with the present invention is a vehicle engine including: a cylinder head; a cam housing fixed to a top of the cylinder head; a cam cap fixed to a top of the cam housing; a camshaft rotatably supported between the cam housing and the cam cap, the camshaft supporting a cam; a rocker arm configured to be pushed by the cam; a valve configured to operate by being pushed by the rocker arm; and an oil pipe that is formed integrally with the cam housing. Lubricant oil is supplied through the oil pipe to a contact point between the cam and the rocker arm.

Another aspect of the present invention is a vehicle engine including: a cylinder head; cam housing fixed to a top of the cylinder head; a cam cap fixed to a top of the cam housing; a camshaft rotatably supported between the cam housing and the cam cap, the camshaft supporting a cam; a rocker arm configured to be pushed by the cam; a valve configured to operate by being pushed by the rocker arm; and an oil path that is formed between the cam housing and the cam cap. Lubricant oil is supplied through the oil path to a contact point between the cam (18) and the rocker arm.

DETAILED DESCRIPTION

<First Embodiment>

A first embodiment in accordance with the present invention will be described with the drawings.

Figure 1:
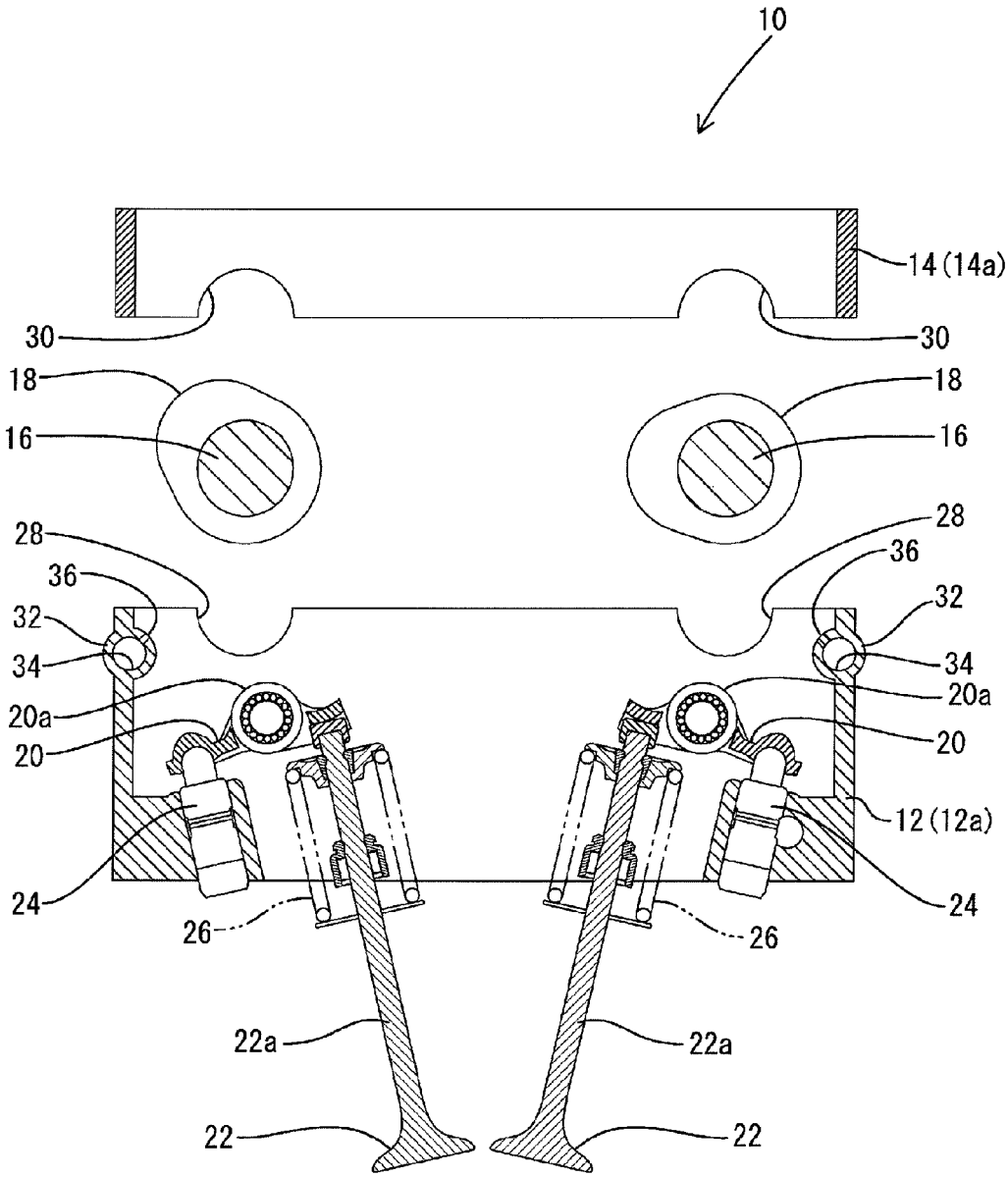
FIG. 1 is a sectional view of a vehicle engine of a first embodiment, illustrating a state before a cam cap is mounted to a cam housing.
Figure 2:
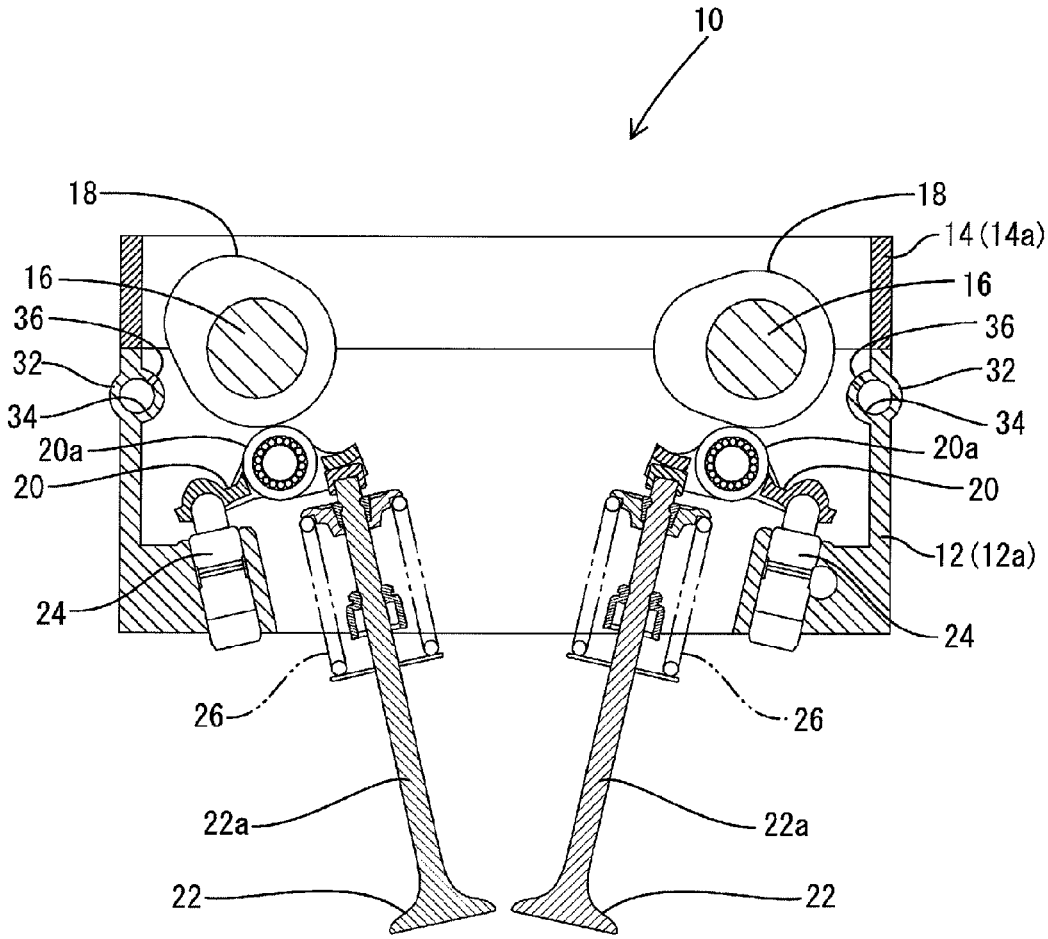
FIG. 2 is a sectional view of the vehicle engine of the first embodiment, illustrating a state after the cam cap is mounted to the cam housing.

As illustrated in FIGS. 1 and 2, a vehicle engine 10 of the present embodiment includes a cylinder head (not illustrated in the drawings), a cam housing 12, a cam cap 14, camshafts 16, rocker arms 20, and valves 22. The cam housing 12 is fixed to a top of the cylinder head. The cam cap 14 is fixed to a top of the cam housing 12. Each camshaft 16 is rotatably supported between the cam housing 12 and the cam cap 14. The camshaft 16 supports cams 18. The cams 18 push the rocker arms 20. The rocker arms 20 push the valves 22 so that the valves 22 operate. The vehicle engine 10 is a so-called DOHC engine, including the left and right camshafts 16 for operating the intake and exhaust valves 22, respectively.

The cam housing is bolted on the top of the cylinder head. The cam housing 12 accommodates the rocker arms 20, the valves 22, lash adjusters 24, and valve springs 26. An end of each rocker arm 20 is supported from below by the corresponding lash adjuster 24, while the other end contacts a stem 22*a* of the corresponding valve 22 from above. As a crankshaft (not illustrated in the drawings) rotates, the camshafts 16 rotate so that the cams 18 push down rollers 20*a* of the rocker arms 20. Then, the rocker arms 20 swing up and down about top ends of the lash adjusters 24 while reciprocating the valves 22 up and down against the elastic forces of the valve springs 26. Thus, the camshafts 16, the cams 18, the rocker arms 20, the lash adjusters 24, and the valve springs 26 are accommodated in the cam housing 12 and configure a valve train for operating the valves 22.

The cam cap 14 is bolted on the top of the cam housing 12. The cam housing 12 and the cam cap 14 are made of metal such as aluminium alloy. The cam housing 12 and the cam cap 14 can be manufactured by, for example, die casting.

Figure 3:
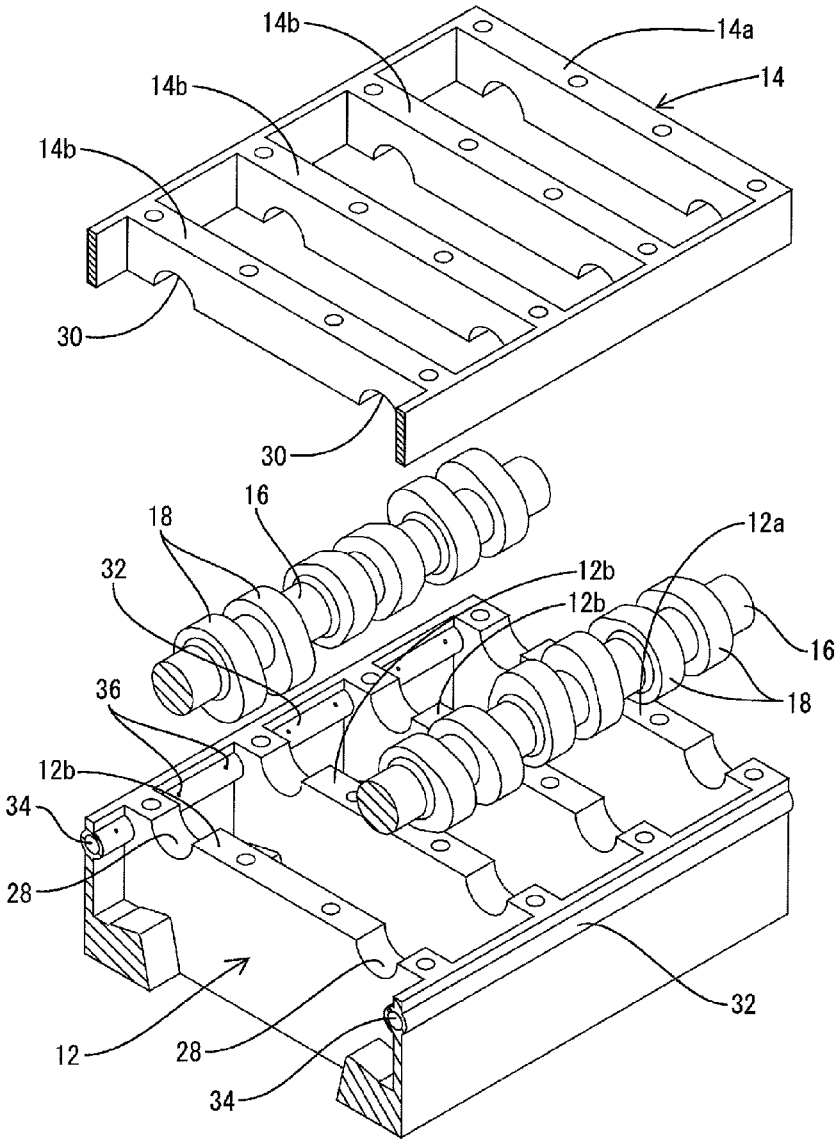
FIG. 3 is a perspective view of the cam housing, a cam shaft, and the cam cap of the first embodiment.
Figure 4:
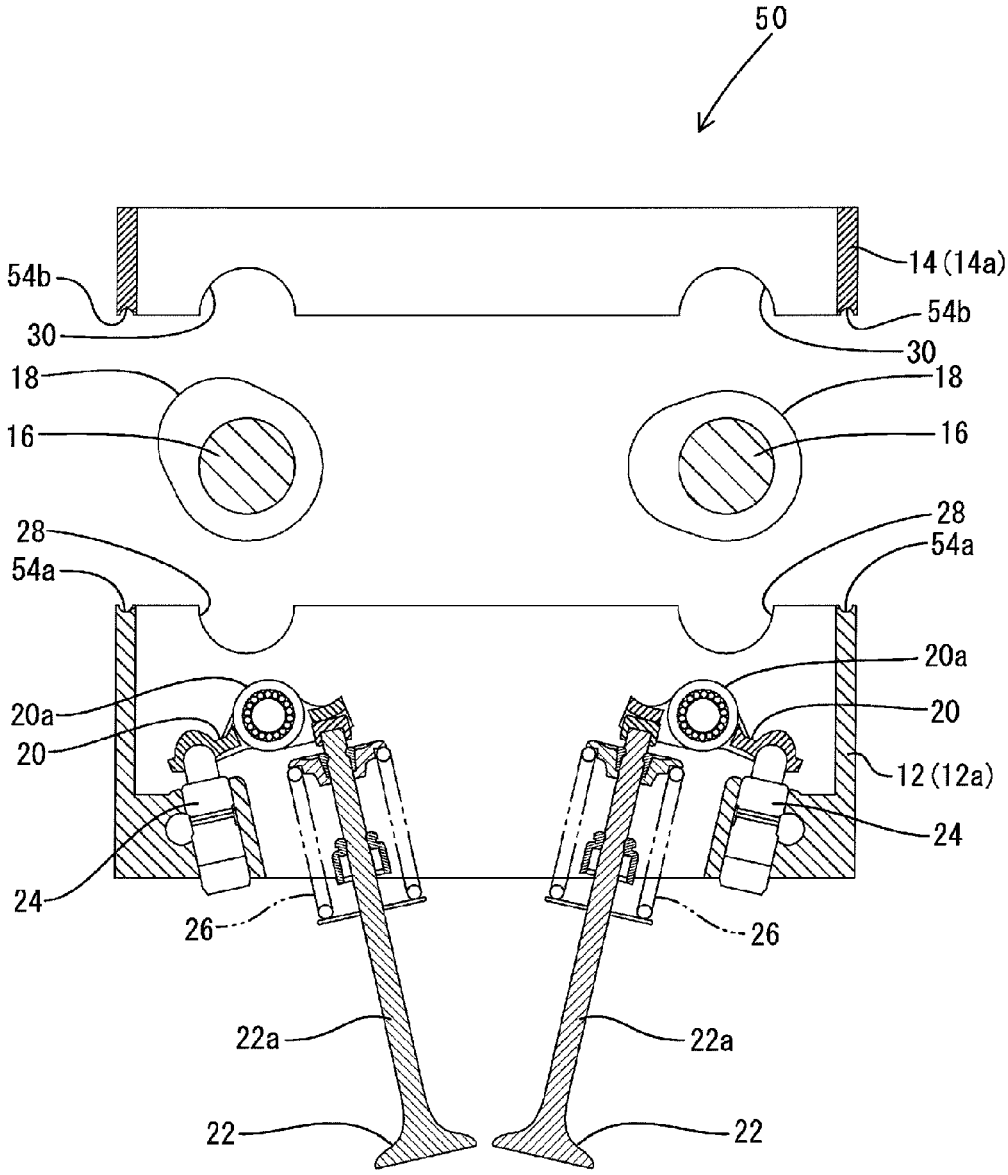
FIG. 4 is a sectional view of a vehicle engine of a second embodiment, illustrating a state before the cam cap is mounted to the cam housing.
Figure 5:
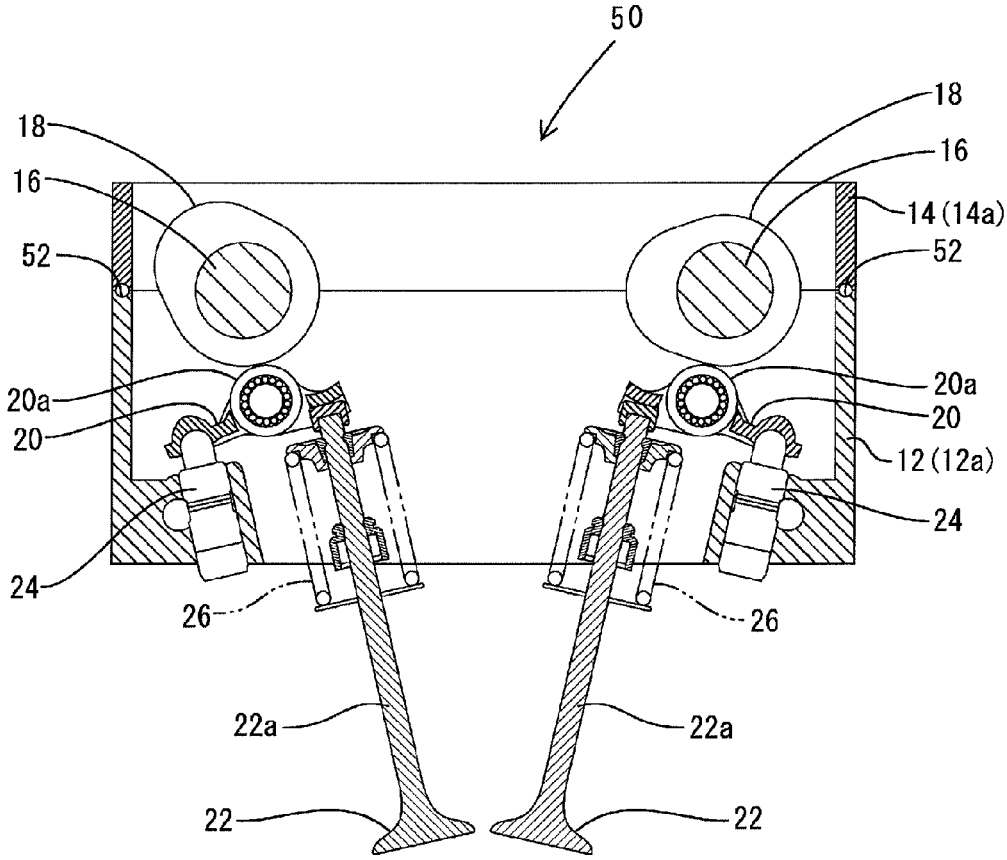
FIG. 5 is a sectional view of the vehicle engine of the second embodiment, illustrating a state after the cam cap is mounted to the cam housing.
Figure 6:
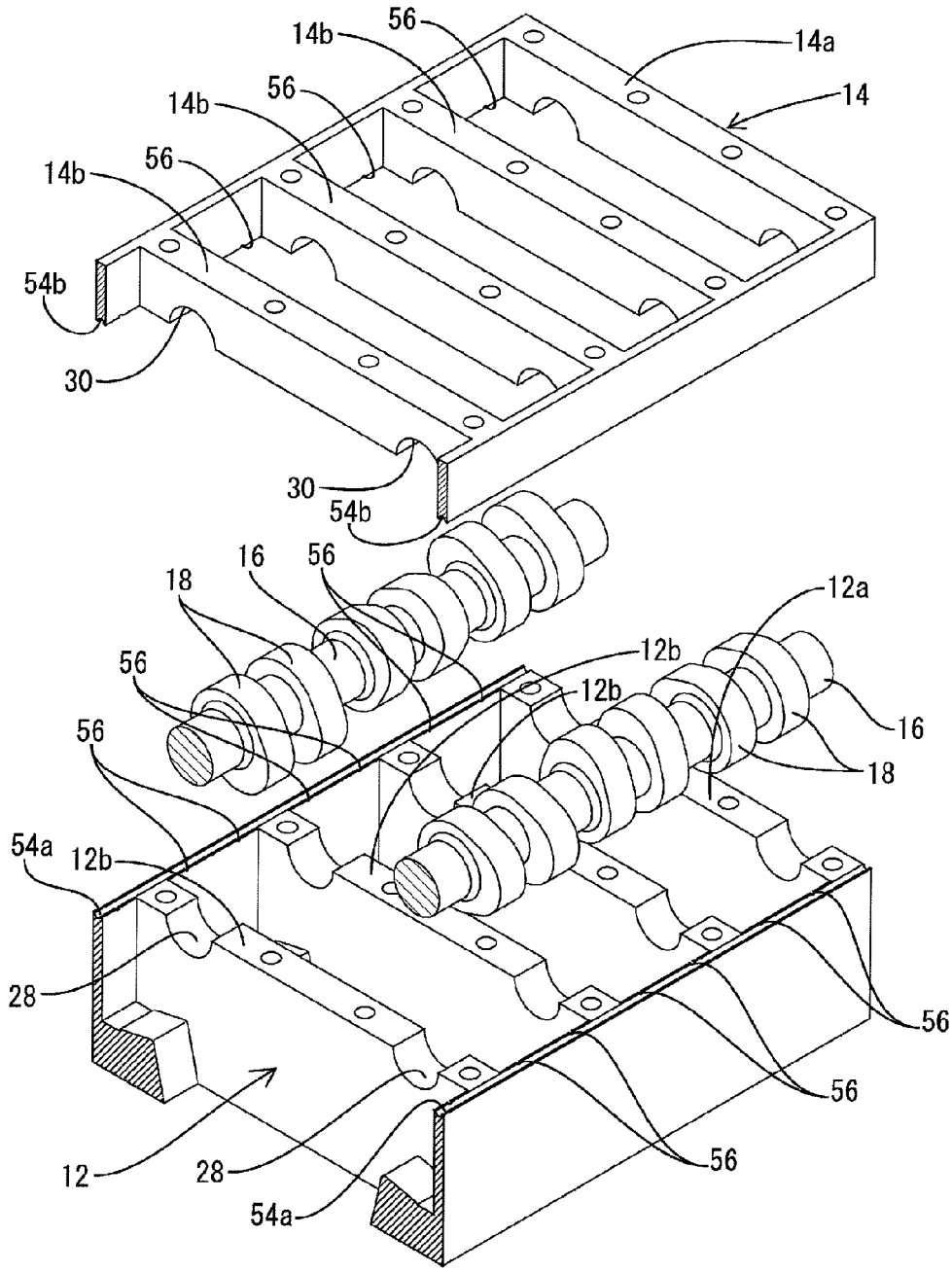
FIG. 6 is a perspective view of the cam housing, the cam shaft, and the cam cap of the second embodiment.
Figure 7:
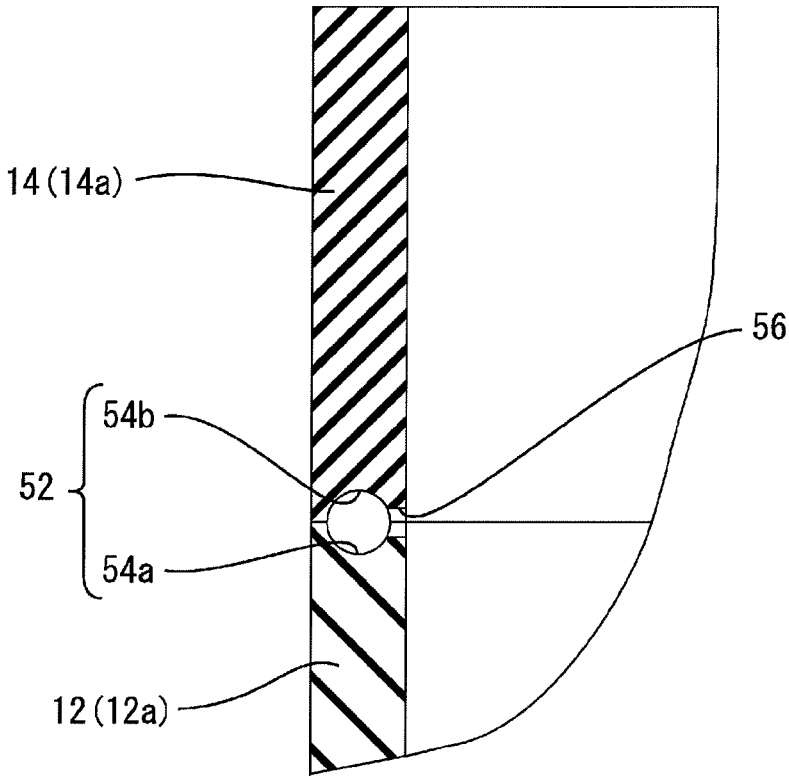
FIG. 7 is an enlarged sectional view of an oil path.

As illustrated in FIG. 3, the cam housing 12 includes a rectangular outer frame 12*a* and partitions 12*b*. The outer frame 12*a* defines a space, while the partitions 12*b* partition the space into a plurality of subspaces. Similar to this, the cam cap 14 includes a rectangular outer frame 14*a* and partitions 14*b*. The outer frame 14*a* defines a space, while the partitions 14*b* partition the space into a plurality of subspaces. Each of the subspaces defined by the partitions 12*b*, 14*b* accommodates the valve train components for operating the cylinder valves 22 of the vehicle engine 10.

Each camshaft 16 is a round bar made with metallic material such as JIS STKM (Carbon Steel Tubes for Machine Structural Purposes) etc. The plurality of cams 18 are integrally provided on the circumference of the camshaft 16. The cams 18 are arranged in the axial direction of the camshaft 16.

Each camshaft 16 is rotatably supported between the cam housing 12 and the cam cap 14. Specifically, the camshaft 16 is rotatably supported between bearing recesses 28 and bearing recesses 30. Each of the bearing recesses 28, 30 is generally semicircular in cross section. The bearing recesses 28 are formed in the top face of the cam housing 12. The bearing recesses 30 are formed in the bottom face of the cam cap 14 (see FIG. 1).

Two oil pipes 32 are integral parts of the cam housing 12. Through the oil pipes 32, lubricant oil (hereinafter simply referred to as "oil") is supplied to the contact points between the cams 18 and the rollers 20*a* of the rocker arms 20. The oil pipes 32 can be formed integrally with the cam housing 12 in, for example, a die-casting process for manufacturing the cam housing 12. The oil pipes 32 extend substantially parallel to the axial direction of the camshafts 16 and through the thicknesses of the partitions 12*b*. Each oil pipe 32 has a center hole 34 running through the axis thereof. The center hole 34 is bored with a tool such as a drill. The center hole 34 is an oil flow path.

Each oil pipe 32 has a plurality of oil holes 36 arranged at predetermined intervals in the axial direction of the oil pipe 32. Each oil hole 36 is approximately from 1 mm to 2 mm in diameter. The oil hole 36 runs through the thickness of the pipe wall of the oil pipe 32, obliquely upward from the center hole 34.

An oil pump pumps up oil from an oil pan. The oil is then forced through an oil gallery (not illustrated in the drawings) in the cam housing 12 to the oil pipes 32, and then is injected from the oil holes 36 toward the cams 18 and the rocker arms 20. Thus, oil is supplied to the contact points between the cams 18 and the rocker arms 20.

As described above, the vehicle engine 10 of this embodiment includes the oil pipes 32 that are provided integrally with the cam housing 12. Therefore, no member separate from the cam housing 12 or from the cam cap 14 is necessary as the oil pipes 32. The parts count of the vehicle engine 10 can be lower accordingly.

<Second Embodiment>

A second embodiment in accordance with the present invention will be described with reference to the drawings.

A vehicle engine 50 of this embodiment has a configuration similar to the vehicle engine 10 of the first embodiment, except that the oil pipes are provided between the cam housing and the cam cap. The components similar to the first embodiment will be designated with the same reference characters, while the explanation will be omitted.

As illustrated in FIGS. 4 through 7, the vehicle engine 50 includes oil paths 52 between the cam housing 12 and the cam cap 14. Specifically, each oil path 52 is formed with grooves 54*a*, 54*b*. Each of the grooves 54*a*, 56*b* is generally semicircular in cross section. The groove 54*a* is formed in the top face of the outer frame 12*a* of the cam housing 12. The groove 54*b* is formed in the bottom face of the outer frame 14*a* of the cam cap 14. The grooves 54*a*, 54*b* can be formed by, for example, cutting the cam housing 12 and the cam cap 14, respectively.

Each oil path 52 has a plurality of oil holes 56 arranged at predetermined intervals in the axial direction of the oil path 52. Each oil hole 56 is approximately from 1 mm to 2 mm in diameter. The oil hole 56 runs through the thickness of the path wall of the oil path 52, laterally toward the camshaft 16 (see FIG. 7).

The oil pump pumps up oil from the oil pan. The oil is then forced through the oil gallery (not illustrated in the drawings) in the cam housing 12 to the oil paths 52, and then is injected from the oil holes 56 toward the cams 18 and the rocker arms 20. Thus, oil is supplied to the contact points between the cams 18 and the rocker arms 20.

As described above, the vehicle engine 50 of this embodiment includes the oil paths 52 that are defined between the cam housing 12 and the cam cap 14. Therefore, no member separate from the cam housing 12 or from the cam cap 14 is necessary as the oil paths 52. The parts count of the vehicle engine 50 can be lower accordingly.

What is claimed is:

1. A vehicle engine comprising:

a cylinder head;

a cam housing provided to the cylinder head, the cam housing having a plurality of cam housing bearing recesses and at least two cam housing side walls that each have a cam housing surface;

a cam cap having a lurality of cam cap bearing recesses and at least two cam cap side walls, the cam cap side walls each having a cam cap surface, the cam cap being fixed to the cam housing such that the cam cap surfaces face the cam housing surfaces as corresponding pairs;

a plurality of camshafts rotatably supported between the cam housing bearing recesses and the cam cap bearing recesses;

a plurality of cams provided to the camshafts;

a plurality of rocker arms configured to be pushed by the cams; and a plurality of valves configured to operate by being pushed by the rocker arms, wherein at least one of the cam housing surface and the cam cap surface of each of the corresponding pairs has a groove extending along the at least one of the cam housing surface and the cam cap surface to integrally form an oil supply path between the cam housing surface and the cam cap surface, the oil supply paths correspond in number to the camshafts, the oil supply paths are integrally formed with the at least two cam housing side walls, respectively, so as to be provided along each of the at least two cam housing side walls, and lubricant oil is supplied through the oil supply paths to contact points between the cams and the rocker arms.

2. The vehicle engine according to claim 1, wherein the cam cap, the oil supply paths, and the cam housing are made of an identical material.

3. The vehicle engine according to claim 1, wherein each of the cam cap surface and the cam housing surface of each of the corresponding pairs has a groove extending along each of the cam cap surface and the cam housing surface, and the groove of the cam cap surface is connected to the groove of the cam housing surface of each of the corresponding pairs to form the oil supply paths.

4. The vehicle engine according to claim 1, wherein the oil supply paths include a plurality of oil supply holes through which the lubricant oil is supplied toward the contact points, and the oil supply holes are provided to correspond to the cams, respectively.

5. The vehicle engine according to claim 4, wherein the oil supply holes are formed at connection points between the cam housing surfaces and the cam cap surfaces.

* * * * *